US009828013B2

(12) United States Patent
Shubs, Jr. et al.

(10) Patent No.: US 9,828,013 B2
(45) Date of Patent: Nov. 28, 2017

(54) TRAIN ASSET AVAILABILITY AND RELIABILITY MANAGEMENT SYSTEM

(71) Applicant: Electro-Motive Diesel, Inc., Lagrange, IL (US)

(72) Inventors: Alexander Shubs, Jr., Chicago, IL (US); James David Seaton, Westmont, IL (US); David Matthew Roenspies, Elburn, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 51 days.

(21) Appl. No.: 14/935,949

(22) Filed: Nov. 9, 2015

(65) Prior Publication Data

US 2017/0129512 A1 May 11, 2017

(51) Int. Cl.

*B61L 27/00* (2006.01)
*G07C 5/08* (2006.01)
*G07C 5/00* (2006.01)

(52) U.S. Cl.

CPC ..... *B61L 27/0094* (2013.01); *G07C 5/008* (2013.01); *G07C 5/085* (2013.01)

(58) Field of Classification Search

CPC combination set(s) only.
See application file for complete search history.

(56) References Cited

U.S. PATENT DOCUMENTS 5,681,015 A * 10/1997 Kull ..... B60T 13/665 246/167 R
8,364,338 B2 1/2013 Peltonen et al.
8,620,714 B2 12/2013 Williams et al.
2003/0094546 A1* 5/2003 Kellner ..... B61L 15/0027 246/167 R
2003/0223387 A1* 12/2003 Davenport ..... H04W 84/005 370/328
2007/0219683 A1* 9/2007 Daum ..... B61L 3/006 701/19
2016/0080223 A1* 3/2016 Shubs, Jr. ..... H04L 41/0609 709/224
2016/0121912 A1* 5/2016 Puttagunta ..... B61L 23/34 701/19

* cited by examiner

*Primary Examiner* — Edward J Pipala
(74) *Attorney, Agent, or Firm* — Finnegan, Henderson, Farabow, Garrett & Dunner LLP

(57) ABSTRACT

A method for managing train assets increases the time between required maintenance of the train assets, improves the future availability of the train assets, or increases the likelihood that the train assets will successfully complete future missions. A controller may receive from a sensor on a train asset a real-time signal indicative of at least one of a measured operational characteristic or a maintenance activity associated with the train asset, receive from a memory prognostic data providing information on a likelihood the train asset will complete a mission, and simulate a hypothetical operational scenario (HOS) based at least in part on the prognostic data and involving one or more train assets. Predictive data associated with the HOS may provide information on a likely benefit to a train asset from a change in at least one of an operational parameter, designated operational configuration for the train assets, or maintenance-related activity.

18 Claims, 4 Drawing Sheets

TRAIN ASSET AVAILABILITY AND RELIABILITY MANAGEMENT SYSTEM

TECHNICAL FIELD

The present disclosure relates generally to a train management system and, more particularly, to a train asset availability and reliability management system.

BACKGROUND

Train assets may include multiple powered units, such as locomotives, that are mechanically coupled or linked together in a consist. In addition to the powered units, train assets may also include non-powered units such as freight cars, passenger cars, and other rail vehicles, and stationary wayside equipment located along the railroad network. The consist of powered units operates to provide tractive and/or braking efforts to propel and stop movement of the rail vehicles. The powered units in the consist may change the supplied tractive and/or braking efforts based on a data message that is communicated to the powered units. For example, the supplied tractive and/or braking efforts may be based on Positive Train Control (PTC) instructions or control information for an upcoming trip. The control information may be used by a software application to determine the speed of the rail vehicle for various segments of an upcoming trip of the rail vehicle. The rail vehicles include many components that are susceptible to wear and failure over time. Managing a fleet of train assets is challenging given the range in age, current maintenance status, and variability in mean time between failures of train assets. These train asset parameters are difficult to monitor and manage, and influence the likelihood that a train will be able to achieve its mission parameters.

A goal in the operation of the locomotives and other train assets in a train is to eliminate the need for an operator on-board the train. Automatic Train Operation (ATO) may also allow operators on-board the train or at an off-board location (back office) to manage an entire fleet of train assets in an efficient, effective, and safe manner. In order to achieve the goal of providing automatic train operation (ATO), a reliable control system must be provided in order to transmit train control commands and other data indicative of operational characteristics associated with various subsystems of the locomotive consists between the train and an off-board, remote controller interface (e.g., one or more servers located at the "back office"). The control system must be capable of transmitting data messages having the information used to control the tractive and/or braking efforts of the rail vehicle and the operational characteristics of the various consist subsystems, equipment, and components while the rail vehicle is moving. The control system must also be able to transmit information regarding a detected fault on-board a locomotive, and respond with control commands to reset the fault.

One example of a train that includes a control system that allows the transfer of control commands from a lead locomotive to a remote locomotive is disclosed in U.S. Pat. No. 8,364,338 of Peltonen et al. that issued on Jan. 29, 2013 ("the '338 patent"). In particular, the '338 patent discloses a system and method for remotely administering a fault detected on an unmanned powered system that is controlled through a lead powered system. The method includes detecting an operational fault on an unmanned powered system, communicating information about the fault to the lead powered system through a wireless communication protocol, and communicating a reset message to the unmanned powered system.

Although useful in allowing for control of an unmanned remote trailing locomotive in a train by wireless signals sent from a lead locomotive of the train, the system of the '338 patent may be limited. In particular, the '338 patent does not provide a way for a remote operator at a back office or other remote controller interface, or a third party located remotely and with access only to an Internet-connected terminal, to receive information on the status of a locomotive and send commands to the locomotive from the remote controller interface or remote, Internet-connected terminal. The system of the '338 patent also does not take into consideration the requirements for efficiently managing the availability and reliability of an entire fleet of train assets, or for predicting the likelihood that one or more train assets will be able to complete a mission.

The present disclosure is directed at overcoming one or more of the shortcomings set forth above and/or other problems of the prior art.

SUMMARY

In one aspect, the present disclosure is directed to a train asset management system. The train asset management system may include a plurality of sensors associated with various assets of a train, each of the plurality of sensors being configured to generate a real-time signal indicative of at least one of a measured operational characteristic, a maintenance activity, or a failure associated with a train asset, and a controller configured to receive the real-time signals from the sensors, and receive from memory prognostic data providing information on the likelihood a train asset will complete a mission. The controller may be configured to simulate a first hypothetical operational scenario (HOS) based at least in part on the prognostic data and involving one or more train assets, determine predictive data associated with the first HOS providing information on a likely benefit to a train asset from a change in at least one of an operational parameter, a designated operational configuration for the train assets, or a maintenance-related activity, successively simulate one or more additional HOS, determine additional predictive data based on the one or more additional HOS, and compare the predictive data from successive HOS. The controller may also be configured to determine any changes in at least one of time between required maintenance procedures for the train asset, availability of the train asset, or likelihood that the train asset will successfully complete a mission, and initiate control commands based on the predictive data corresponding to a HOS with desired improvements to operational characteristics for the train assets.

In another aspect, the present disclosure is directed to a computer-implemented method for managing train assets in order to at least one of increase the time between required maintenance of the train assets, improve the availability of the train assets, or increase the likelihood that the train assets will successfully complete a mission. The method may include receiving from a sensor on a train asset a real-time signal indicative of at least one of a measured operational characteristic or a maintenance activity associated with the train asset, and receiving from a memory prognostic data providing information on the likelihood the train asset will complete a mission. The method may also include simulating a first hypothetical operational scenario (HOS) based at least in part on the prognostic data and involving one or more train assets, determining predictive data associated with the first HOS providing information on a likely benefit to a train asset from a change in at least one of an operational parameter, a designated operational configuration for the train assets, or a maintenance-related activity, successively simulating one or more additional HOS, determining additional predictive data based on the one or more additional HOS, and comparing the predictive data from successive HOS. The method may further include determining any changes in at least one of time between required maintenance procedures for the train asset, availability of the train asset, or likelihood that the train asset will successfully complete a mission, and initiating control commands based on the predictive data corresponding to a HOS with desired improvements to operational characteristics for the train assets.

In yet another aspect, the present disclosure is directed to one or more non-transitory computer-readable media comprising computer-executable instructions that, when executed on one or more processors, perform acts that at least one of increase the time between required maintenance of one or more train assets, improve the availability of the one or more train assets, or increase the likelihood that the one or more train assets will successfully complete a mission. The method may include receiving from a sensor on a train asset a real-time signal indicative of at least one of a measured operational characteristic or a maintenance activity associated with the train asset, and receiving from a memory prognostic data providing information on the likelihood the train asset will complete a mission. The method may also include simulating a first hypothetical operational scenario (HOS) based at least in part on the prognostic data and involving one or more train assets, determining predictive data associated with the first HOS providing information on a likely benefit to a train asset from a change in at least one of an operational parameter, a designated operational configuration for the train assets, or a maintenance-related activity, successively simulating one or more additional HOS, determining additional predictive data based on the one or more additional HOS, and comparing the predictive data from successive HOS. The method may further include determining any changes in at least one of time between required maintenance procedures for the train asset, availability of the train asset, or likelihood that the train asset will successfully complete a mission, and initiating control commands based on the predictive data corresponding to a HOS with desired improvements to operational characteristics for the train assets.

DETAILED DESCRIPTION

Figure 1:
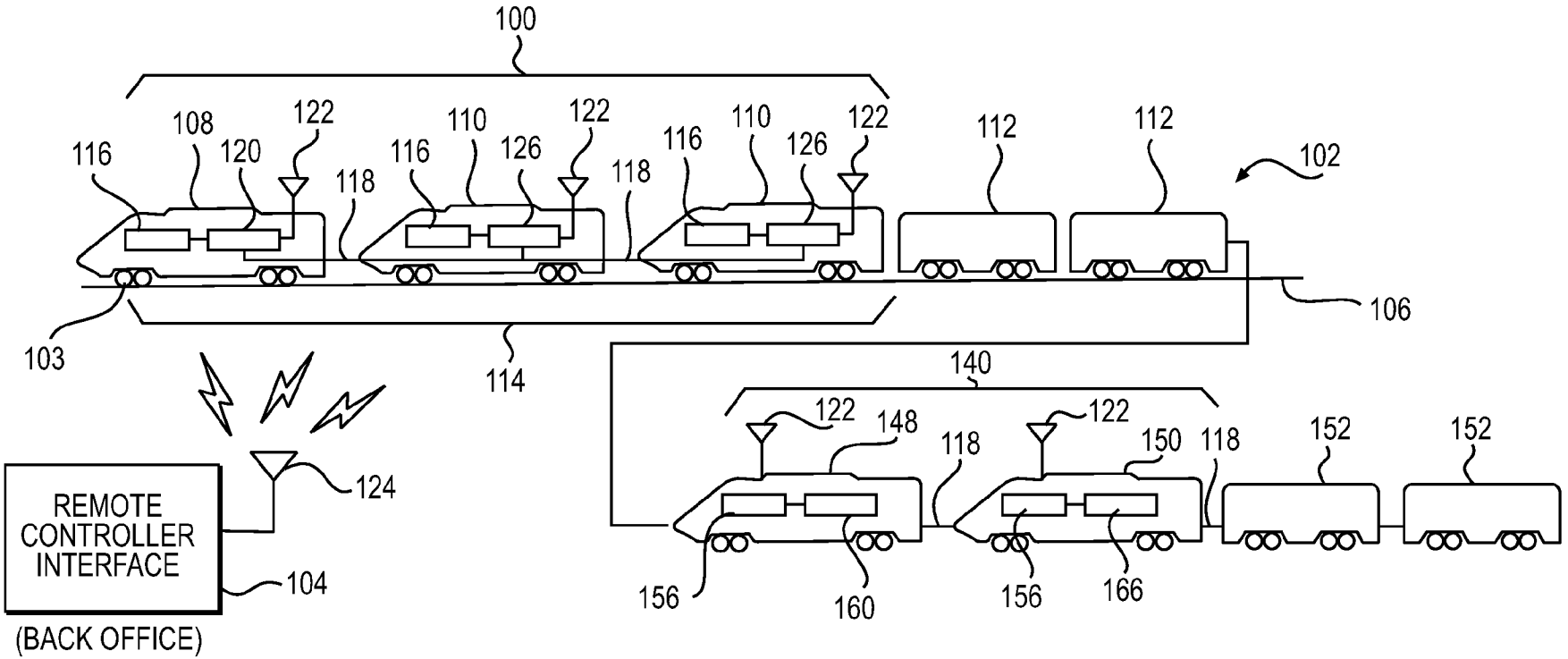
FIG. 1 is a schematic diagram of one embodiment of a control system and associated train assets.

FIG. 1 is a schematic diagram of one embodiment of a control system 100 for operating a train 102 traveling along a track 106. The train may include multiple train assets (including powered and/or non-powered rail cars or units) linked together as one or more consists or a single rail car (a powered or non-powered rail car or unit). The control system 100 may provide for cost savings, improved safety, increased availability and reliability of train assets, operational flexibility, and convenience in the control of the train 102 through communication of network data between an off-board remote controller interface 104 and the train 102. The control system 100 may also provide a means for remote operators or third party operators to communicate with the various locomotives or other powered units of the train 102 from remote interfaces that may include any computing device connected to the Internet or other wide area or local communications network. The control system 100 may be used to convey a variety of network data and command and control signals in the form of messages communicated to the train 102, such as packetized data or information that is communicated in data packets, from the off-board remote controller interface 104. The off-board remote controller interface 104 may also be configured to receive remote alerts and other data from a controller on-board the train, and forward those alerts and data to desired parties via pagers, mobile telephone, email, and online screen alerts. The data communicated between the train 102 and the off-board remote controller interface 104 may include signals indicative of various operational parameters or maintenance activities associated with components, equipment, subsystems, and systems of the train, and command and control signals operative to change the state of various circuit breakers, throttles, brake controls, actuators, switches, handles, relays, and other electronically-controllable devices on-board any locomotive or other powered unit of the train 102.

The control system 100 may also include a train asset management system. The train asset management system may include a plurality of sensors associated with components, equipment, subsystems, and systems of various assets of a train, and one or memories associated with one or more processors located on-board and/or off-board the train. Each of the plurality of sensors may be configured to generate a real-time signal indicative of at least one of a measured operational characteristic or a maintenance activity associated with a train asset. The train asset management system of control system 100 may be configured to receive the real-time signals from the sensors, and receive from one or more memories on-board or off-board the train prognostic data providing information on the likelihood a train asset will complete a mission. Prognostic data is objectively measurable data, such as the age of a particular train asset, the length of time or number of miles the asset has been in service, the length of time during which the propulsion subsystems of the asset have been operated above a threshold level of power output, the types of loads the train asset has been subjected to, the terrain and environmental conditions under which the train asset has been operated, the timing and nature of any maintenance activities performed on the asset, the particular type, make, or model of the asset, and the type of propulsion subsystem and fuel used by the asset.

The train asset management system may be configured to simulate one or more hypothetical operational scenarios (HOS) based at least in part on the prognostic data and involving one or more train assets. Simulation of the HOS involving one or more train assets may include the control system running successive simulations of operation of the various train assets under different operating conditions, for different periods of time, and with different operational parameters and designated operational configurations to predict how various factors affect availability and reliability of the assets. Simulations of operation of the train assets may be based at least in part on the prognostic data, and on one or more of historical data, empirical data, theoretical data derived from physics-based equations and algorithms, and statistically-derived data based on past performance of the asset or other assets that are of the same or similar type, make, or model. An example of a change in a designated operational configuration for a plurality of train assets may include activating operational control devices on-board a locomotive in a consist to change the designated operational configuration of the locomotive between lead locomotive for the consist and trailing locomotive. Comparison of the operational characteristics associated with two HOS having different designated operational configurations for the train assets may reveal benefits to reliability and/or availability of the assets. The train asset management system may also be configured to determine, for example, that running a propulsion subsystem at a certain percentage of its full power generation capacity for a certain number of hours and under certain environmental conditions is predicted to result in the need to perform particular maintenance activities before the train asset will be available for continued operation at preferred performance levels. In an alternative HOS, the train asset management system may determine that replacing certain components when they have worn beyond a predetermined threshold, or when their performance has dropped below a certain threshold level, but before failure is expected, may improve availability of the asset in spite of more frequent, but shorter periods of down time.

The train asset management system of the control system may determine predictive data associated with a first HOS providing information on a likely benefit to a train asset from a change in at least one of an operational parameter, a designated operational configuration for the train assets, or timing or character of a maintenance-related activity. For example, the train asset management system may determine from running successive simulations to make changes to the timing or character of various maintenance activities, such as changing fluids, or replacing or repairing worn components after they have passed a certain dimensional or performance threshold, but before they actually fail. The train asset management system may be configured to determine from comparison of a plurality of HOS and associated predictive data that certain operational or maintenance changes may result in an increase of the overall availability or reliability of the assets over a period of time. The train asset management system may successively generate one or more additional HOS, dependent at least in part on one or more prognostic factors, and determine additional predictive data based on the one or more additional HOS, and compare the predictive data from successive HOS. The system may also be configured to determine any changes in at least one of time between required present or future maintenance procedures for the train asset, present or future availability of the train assets, or likelihood that the train assets will successfully complete present or future missions. The results of the determinations made by the train asset management system after running successive HOS may be used to initiate control commands based on the predictive data corresponding to a HOS with desired improvements to operational characteristics for the train assets. In various alternative implementations of the control system, the train asset management functions may be performed entirely on-board the train asset, entirely off-board the train asset, such as at the off-board remote controller interface 104, or partially on-board and partially off-board the asset.

The off-board remote controller interface 104 may be connected with an antenna module 124 configured as a wireless transmitter or transceiver to wirelessly transmit data messages to the train 102. The messages may originate elsewhere, such as in a rail-yard back office system, one or more remotely located servers (such as in the "cloud"), a third party server, a computer disposed in a rail yard tower, and the like, and be communicated to the off-board remote controller interface 104 by wired and/or wireless connections. Alternatively, the off-board remote controller interface 104 may be a satellite that transmits the message down to the train 102 or a cellular tower disposed remote from the train 102 and the track 106. Other devices may be used as the off-board remote controller interface 104 to wirelessly transmit the messages. For example, other wayside equipment, base stations, or back office servers may be used as the off-board remote controller interface 104. By way of example only, the off-board remote controller interface 104 may use one or more of the Transmission Control Protocol (TCP), Internet Protocol (IP), TCP/IP, User Datagram Protocol (UDP), or Internet Control Message Protocol (ICMP) to communicate network data over the Internet with the train 102. As described below, the network data can include information used to automatically and/or remotely control operations of the train 102 or subsystems of the train, and/or reference information stored and used by the train 102 during operation of the train 102. The network data communicated to the off-board remote controller interface 104 from the train 102 may also provide alerts and other operational information that allows for remote monitoring, diagnostics, train asset management as described above, and tracking of the state of health of all of the components, equipment, primary power systems and auxiliary subsystems such as HVAC, air brakes, lights, event recorders, and the like.

The train 102 may include a lead consist 114 of powered locomotives, including the interconnected powered units 108 and 110, one or more remote or trailing consists 140 of powered locomotives, including powered units 148, 150, and additional non-powered units 112, 152. "Powered units" refers to rail cars that are capable of self-propulsion, such as locomotives. "Non-powered units" refers to rail cars that are incapable of self-propulsion, but which may otherwise receive electric power for other services. For example, freight cars, passenger cars, and other types of rail cars that do not propel themselves may be "non-powered units", even though the cars may receive electric power for cooling, heating, communications, lighting, and other auxiliary functions.

In the illustrated embodiment of FIG. 1, the powered units 108, 110 represent locomotives joined with each other in the lead consist 114. The lead consist 114 represents a group of two or more locomotives in the train 102 that are mechanically coupled or linked together to travel along a route. The lead consist 114 may be a subset of the train 102 such that the lead consist 114 is included in the train 102 along with additional trailing consists of locomotives, such as trailing consist 140, and additional non-powered units 152, such as freight cars or passenger cars. While the train 102 in FIG. 1 is shown with a lead consist 114, and a trailing consist 140, alternatively the train 102 may include other numbers of locomotive consists joined together or interconnected by one or more intermediate powered or non-powered units that do not form part of the lead and trailing locomotive consists.

The powered units 108, 110 of the lead consist 114 include a lead powered unit 108, such as a lead locomotive, and one or more trailing powered units 110, such as trailing locomotives. As used herein, the terms "lead" and "trailing" are designations of different powered units, and do not necessarily reflect positioning of the powered units 108, 110 in the train 102 or the lead consist 114. For example, a lead powered unit may be disposed between two trailing powered units. Alternatively, the term "lead" may refer to the first powered unit in the train 102, the first powered unit in the lead consist 114, and the first powered unit in the trailing consist 140. The term "trailing" powered units may refer to powered units positioned after a lead powered unit. In another embodiment, the term "lead" refers to a powered unit that is designated for primary control of the lead consist 114 and/or the trailing consist 140, and "trailing" refers to powered units that are under at least partial control of a lead powered unit.

The powered units 108, 110 include a connection at each end of the powered unit 108, 110 to couple propulsion subsystems 116 of the powered units 108, 110 such that the powered units 108, 110 in the lead consist 114 function together as a single tractive unit. The propulsion subsystems 116 may include electrical and/or mechanical devices and components, such as diesel engines, electrical generators, and traction motors, used to provide tractive effort that propels the powered units 108, 110 and braking effort that slows the powered units 108, 110.

Similar to the lead consist 114, the embodiment shown in FIG. 1 also includes the trailing consist 140, including a lead powered unit 148 and a trailing powered unit 150. The trailing consist 140 may be located at a rear end of the train 102, or at some intermediate point along the train 102. Non-powered units 112 may separate the lead consist 114 from the trailing consist 140, and additional non-powered units 152 may be pulled behind the trailing consist 140.

The propulsion subsystems 116 of the powered units 108, 110 in the lead consist 114 may be connected and communicatively coupled with each other by a network connection 118. In one embodiment, the network connection 118 includes a net port and jumper cable that extends along the train 102 and between the powered units 108, 110. The network connection 118 may be a cable that includes twenty seven pins on each end that is referred to as a multiple unit cable, or MU cable. Alternatively, a different wire, cable, or bus, or other communication medium, may be used as the network connection 118. For example, the network connection 118 may represent an Electrically Controlled Pneumatic Brake line (ECPB), a fiber optic cable, or wireless connection. Similarly, the propulsion subsystems 156 of the powered units 148, 150 in the trailing consist 140 may be connected and communicatively coupled to each other by the network connection 118, such as a MU cable extending between the powered units 148, 150.

The network connection 118 may include several channels over which network data is communicated. Each channel may represent a different pathway for the network data to be communicated. For example, different channels may be associated with different wires or busses of a multi-wire or multi-bus cable. Alternatively, the different channels may represent different frequencies or ranges of frequencies over which the network data is transmitted.

The powered units 108, 110 may include communication units 120, 126 configured to communicate information used in the control operations and asset management of various components, equipment, subsystems, and systems such as the propulsion subsystems 116 of the powered units 108, 110. The communication unit 120 disposed in the lead powered unit 108 may be referred to as a lead communication unit. As described below, the lead communication unit 120 may be the unit that initiates the transmission of data packets forming a message to the off-board, remote controller interface 104. For example, the lead communication unit 120 may transmit a message via a WiFi or cellular modem to the off-board remote controller interface 104. The message may contain information on an operational state of the lead powered unit 108, such as a throttle setting, a brake setting, readiness for dynamic braking, the tripping of a circuit breaker on-board the lead powered unit, or other operational characteristics. Additionally, the communication units on each powered and non-powered unit may transmit and receive signals indicative of failures of components, and maintenance activities, such as changes in fluids, repair or replacement of components or systems, and adjustments made to various on-board components and controls. The communication units 126 may be disposed in different trailing powered units 110 and may be referred to as trailing communication units. Alternatively, one or more of the communication units 120, 126 may be disposed outside of the corresponding powered units 108, 110, such as in a nearby or adjacent non-powered unit 112. Another lead communication unit 160 may be disposed in the lead powered unit 148 of the trailing consist 140. The lead communication unit 160 of the trailing consist 140 may be a unit that receives data packets forming a message transmitted by the off-board, remote controller interface 104. For example, the lead communication unit 160 of the trailing consist 140 may receive a message from the off-board remote controller interface 104 providing operational commands that are based upon the information transmitted to the off-board remote controller interface 104 via the lead communication unit 120 of the lead powered unit 108 of the lead consist 114. A trailing communication unit 166 may be disposed in a trailing powered unit 150 of the trailing consist 140, and interconnected with the lead communication unit 160 via the network connection 118.

The communication units 120, 126 in the lead consist 114, and the communication units 160, 166 in the trailing consist 140 may be connected with the network connection 118 such that all of the communication units for each consist are communicatively coupled with each other by the network connection 118 and linked together in a computer network. Alternatively, the communication units may be linked by another wire, cable, or bus, or be linked by one or more wireless connections.

The networked communication units 120, 126, 160, 166 may include antenna modules 122. The antenna modules 122 may represent separate individual antenna modules or sets of antenna modules disposed at different locations along the train 102. For example, an antenna module 122 may represent a single wireless receiving device, such as a single 220 MHz TDMA antenna module, a single cellular modem, a single wireless local area network (WLAN) antenna module (such as a "Wi-Fi" antenna module capable of communicating using one or more of the IEEE 802.11 standards or another standard), a single WiMax (Worldwide Interoperability for Microwave Access) antenna module, a single satellite antenna module (or a device capable of wirelessly receiving a data message from an orbiting satellite), a single 3G antenna module, a single 4G antenna module, and the like. As another example, an antenna module 122 may represent a set or array of antenna modules, such as multiple antenna modules having one or more TDMA antenna modules, cellular modems, Wi-Fi antenna modules, WiMax antenna modules, satellite antenna modules, 3G antenna modules, and/or 4G antenna modules.

As shown in FIG. 1, the antenna modules 122 may be disposed at spaced apart locations along the length of the train 102. For example, the single or sets of antenna modules represented by each antenna module 122 may be separated from each other along the length of the train 102 such that each single antenna module or antenna module set is disposed on a different powered or non-powered unit 108, 110, 112, 148, 150, 152 of the train 102. The antenna modules 122 may be configured to send data to and receive data from the off-board remote controller interface 104. For example, the off-board remote controller interface 104 may include an antenna module 124 that wirelessly communicates the network data from a remote location that is off of the track 106 to the train 102 via one or more of the antenna modules 122. Alternatively, the antenna modules 122 may be connectors or other components that engage a pathway over which network data is communicated, such as through an Ethernet connection.

The diverse antenna modules 122 enable the train 102 to receive the network data transmitted by the off-board remote controller interface 104 at multiple locations along the train 102. Increasing the number of locations where the network data can be received by the train 102 may increase the probability that all, or a substantial portion, of a message conveyed by the network data is received by the train 102. For example, if some antenna modules 122 are temporarily blocked or otherwise unable to receive the network data as the train 102 is moving relative to the off-board remote controller interface 104, other antenna modules 122 that are not blocked and are able to receive the network data may receive the network data. An antenna module 122 receiving data from the off-board device 104 may in turn re-transmit that received data to the appropriate lead communication unit 120 of the lead locomotive consist 114, or the lead communication unit 160 of the trailing locomotive consist 140. Any data packet of information received from the off-board remote controller interface 104 may include header information or other means of identifying which locomotive in which locomotive consist the information is intended for. Although the lead communication unit 120 on the lead consist may be the unit that initiates the transmission of data packets forming a message to the off-board, remote controller interface 104, all of the lead and trailing communication units may be configured to receive and transmit data packets forming messages. Accordingly, in various alternative implementations according to this disclosure, a command control signal providing operational commands for the lead and trailing locomotives may originate at the remote controller interface 104 rather than at the lead powered unit 108 of the lead consist 114.

Each locomotive or powered unit of the train 102 may include a car body supported at opposing ends by a plurality of trucks. Each truck may be configured to engage the track 106 via a plurality of wheels, and to support a frame of the car body. One or more traction motors may be associated with one or all wheels of a particular truck, and any number of engines and generators may be mounted to the frame within the car body to make up the propulsion subsystems 116, 156 on each of the powered units. The propulsion subsystems 116, 156 of each of the powered units may be further interconnected throughout the train 102 along one or more high voltage power cables in a power sharing arrangement. Energy storage devices (not shown) may also be included for short term or long term storage of energy generated by the propulsion subsystems or by the traction motors when the traction motors are operated in a dynamic braking or generating mode. Energy storage devices may include batteries, ultra-capacitors, flywheels, fluid accumulators, and other energy storage devices with capabilities to store large amounts of energy rapidly for short periods of time, or more slowly for longer periods of time, depending on the needs at any particular time. The DC or AC power provided from the propulsion subsystems 116, 156 or energy storage devices along the power cable may drive AC or DC traction motors to propel the wheels. Each of the traction motors may also be operated in a dynamic braking mode as a generator of electric power that may be provided back to the power cables and/or energy storage devices. Control over engine operation (e.g., starting, stopping, fueling, exhaust aftertreatment, etc.) and traction motor operation, as well as other locomotive controls, may be provided by way of various controls housed within a cab supported by the frame of the train 102. In some implementations of this disclosure, initiation of these controls may be implemented in the cab of the lead powered unit 108 in the lead consist 114 of the train 102. In other alternative implementations, initiation of operational controls may be implemented off-board at the remote controller interface 104, or at a powered unit of a trailing consist.

Figure 2:
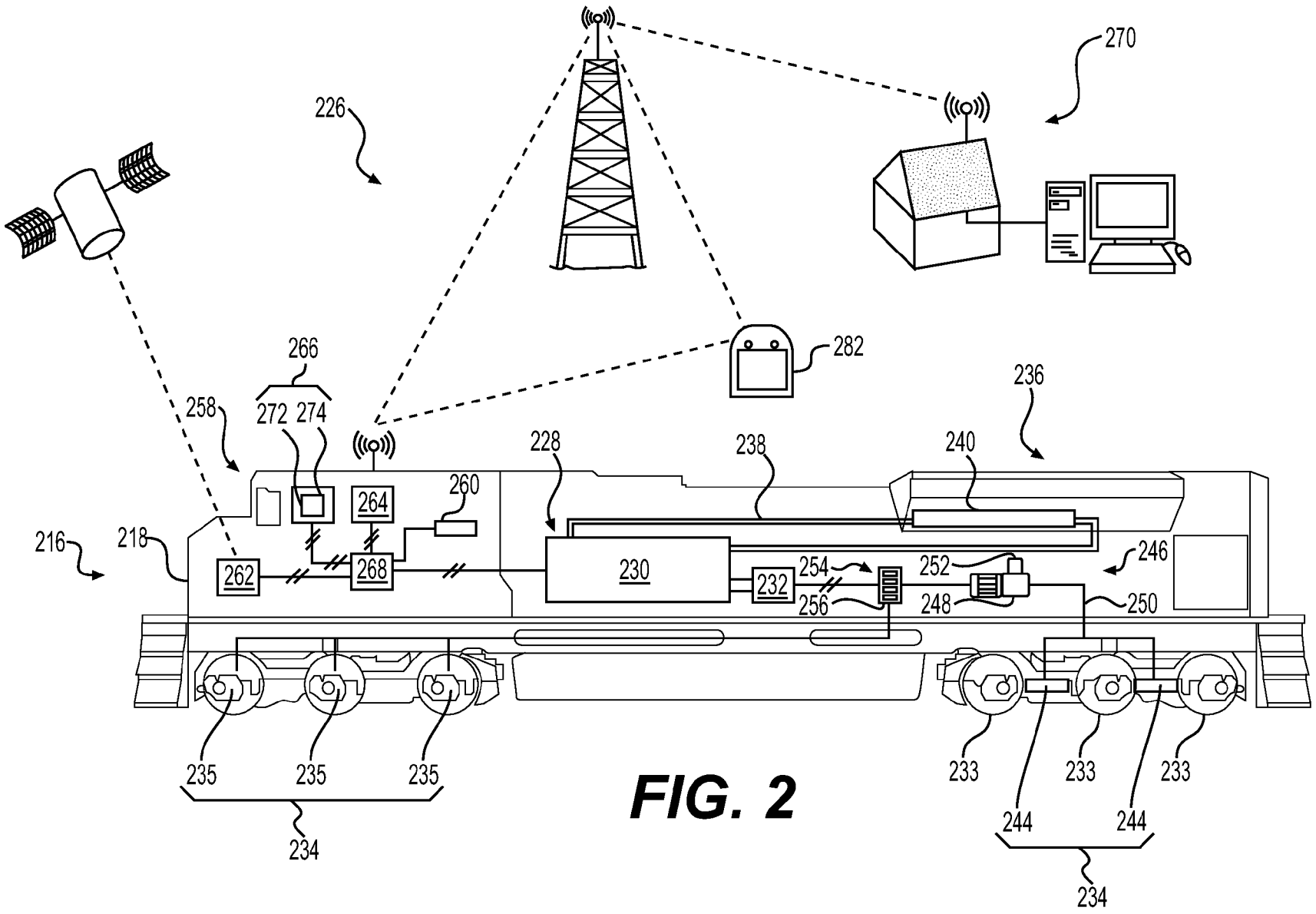
FIG. 2 is a schematic diagram of a portion of the control system and a train asset illustrated in FIG. 1.

FIG. 2 shows an exemplary train asset 216 in communication with an exemplary disclosed train asset management system 226 that may be associated with a railroad network. For the purposes of this disclosure, train asset 216 in FIG. 2 is depicted as a locomotive 218. However, it is noted that any type of train asset 216, including non-powered units such as a freight car, tanker, or other rail equipment, may be a train asset in communication with train asset management system 226.

Locomotive 218 may be a fuel-burning locomotive. For example, locomotive 218 may include an engine system 228 having one or more fuel-burning engines 230. Engine 230 may be an internal combustion engine (e.g., a piston engine or a turbine engine) configured to burn a fuel (e.g., diesel, petrol, natural gas, propane, and/or kerosene) supplied by a fuel system in order to generate a mechanical power output. The output of engine 230 may be used to drive a generator 232 (e.g., an AC generator or a DC generator) configured to supply electricity to a traction system 234 having one or more traction motors 235 for propelling locomotive 218 on a plurality of wheels 233 and axles. Engine 230 may alternatively be configured to directly drive wheels 233 with the mechanical output via drivetrain components, such as gears, clutches, torque converters, and shafts.

A cooling system 236 may be configured to actively cool engine 230 and/or other components of locomotive 218. Cooling system 236 may include, for example, fluid conduits 238 that circulate a cooling fluid (e.g., water, propylene glycol, or other coolants) between a heat source, such as engine 230 or generator 232, and a heat sink, such as a heat exchanger 240. Heat exchanger 240 may include a number of fluid passages configured to allow heated fluid therein to transfer heat to a coolant passing between or around the fluid passages. Cooling system 236 may also include one or more cooling fluid pumps, valves, fans, sensors, and/or other components.

Locomotive 218 may also include one or more brake systems configured to reduce the track speed of locomotive 218. For example, the brake systems may include one or more braking devices 244 positioned near a rotary component such as a brake disk, or a brake drum. Braking devices may include a caliper and pads, shoes and linkages, magnetic brakes, or another type of braking device. As shown in FIG. 2, braking devices 244 may be actuated by a compressed air system 246. In other embodiments, braking devices may be powered hydraulically, mechanically, a combination thereof, or by another method. Locomotive 218 may also or alternatively include other types of braking systems, such as parking brakes, auxiliary brakes, and electronically controlled pneumatic brakes.

Compressed air system 246 may include one or more air compressors 248 configured to pressurize air for use throughout locomotive 218. Pressurized air conduits 250 may be configured to transport pressurized air from compressor 248 to various devices within locomotive 218, such as braking devices 244 and suspension equipment. Compressor 248 may be driven by an electric motor 252 that may be powered by generator 232, a battery, or another source of electricity. In other embodiments, compressor 248 may be autonomously powered by a dedicated engine.

An electrical system 254 may supply and/or control electrical power to various electrical devices associated with locomotive 218. Electrical system 254 may supply electrical power from generator 232, a dedicated engine and generator, one or more batteries or battery banks, a connection to grid power, or another source of electricity. Electrical power may be distributed throughout electrical system 254 via one or more circuit breakers 256. For example, electricity from generator 232 may be distributed to traction motors 235 via circuit breaker 256 for propelling locomotive 218. Electrical system 254 may also power a control system 258 and/or other electronic control devices. Electrical system 254 may include additional circuit breakers, fuses, receptacles, lights, and other components.

Control system 258 may include one or more components associated with manual and/or automatic control of locomotive 218. For example, control system 258 may include the train asset management system in accordance with various implementations of this disclosure. Control system 258 may also include one or more sensors 260, a locating device 262, a communication device 264, a user interface 266, an on-board central processing module (CPM) 268, and operational control devices in communication with each of the other components. Additional and/or other components of control system 258 may be included, if desired. Components of control system 258 may be configured to communicate by wired (e.g., dedicated wire, multi-unit (MU) cable, local area network (LAN), controller area network (CAN), and wide area network (WAN)) and/or wireless (e.g., WiFi, Bluetooth, cellular, satellite, and RFID) connections. Communication device 264 may include a wireless modem, a locomotive interface gateway (LIG), and other communication components required for processing, modulating, transmitting, and receiving wireless signals.

Sensors 260 may be positioned throughout locomotive 218 and other assets 216 of a train. Sensors 260 may each be configured to generate a signal indicative of an operating parameter and/or an operational status of an associated system, subsystem, equipment, and/or component of locomotive 218. Sensors 260 may be configured to generate signals indicative of, for example, temperature, pressure, position, current, voltage, presence (e.g., via optical sensors, cameras, and proximity sensors), air flow, fuel flow, exhaust constituents, air/fuel ratio, and light intensity. One or more sensors 260 may be associated with each of the systems, subsystems, equipment, and/or components of locomotive 218. Signals generated by sensors 260 may also be indicative of an operational status of sensors 260 themselves and/or their associated systems, subsystems, equipment, and/or components. For example, the integrity, strength, and/or nature of the signals generated by sensors 260 may be indicative of whether the respective sensor and/or associated systems, subsystems, and/or components are functioning properly. Various sensors 260 may also be configured to transmit signals indicative of any maintenance activities performed on the various systems, subsystems, equipment, and/or components on-board a train asset. Signals from sensors 260 may be communicated to CPM 268 for further processing.

Locating device 262 may be configured to determine and communicate an absolute and/or relative geographic location of locomotive 218. For example, locating device 262 may include a Global Positioning System (GPS) transponder configured to receive position signals from one or more GPS satellites, an Inertial Reference Unit (IRU), or any other locating device known in the art. Locating device 262 may communicate the positioning signals and/or other information to CPM 268 for further processing.

Communication device 264 may include any device configured to facilitate communications between CPM 268 and off-board entities, such as an off-board server 270. Communication device 264 may include hardware and/or software such as the LIG that enables communication device 264 to process, modulate, send and/or receive data messages through a wireless communication link. Communication device 264 may be configured to communicate via wireless communication platforms, such as by satellite, cellular, infrared, Bluetooth, WiFi, and/or other wireless communication platforms. Communication device 264 may also or alternatively be configured to communicate via a local area network (LAN) or another type of wired network that enables CPM 268 to exchange information with off-board entities.

User interface 266 may be located inside an operator station of locomotive 218, and may include a data entry module 272 for manually receiving data from an operator and a display 274 for displaying information to the operator. Data entry module 272 may include a keyboard, mouse, touchscreen, directional pad, selector buttons, or any other suitable features for recording manually entered data. User interface 266 may also include one or more operational control devices for controlling operations of locomotive 218. For example, user interface 266 may include a throttle control, an automatic brake control, an independent brake handle, a generator switch, a lighting control, and/or other controls. Operational control devices may embody levers, knobs, switches, buttons, slides, handles, touch screens, soft keys, and/or other types of controls. User interface 266 may also be configured to allow the operator to engage or communicate with train and/or train asset control systems. That is, information and requests for input from one or more controllers or control systems may be shown to the operator via display 274, and the operator may provide responses and/or other input via data entry module 272. Inputs entered via data entry module may be communicated to CPM 268 for further processing.

Off-board server 270 may represent one or more computing systems associated with a railroad network, a localized control station, wayside equipment, or other train assets 216 such as locomotive 218. Off-board server 270 may be configured to allow a user to engage a control system associated with multiple trains and/or train assets 216 in a railroad network. Information and requests for input from one or more train and/or train asset control systems may be shown to the user via off-board server 270. Off-board server 270 may also be configured to allow a user to provide responses and/or other inputs to train and/or train asset control systems. Off-board server 270 may be further configured to store periodically updated on-board equipment operational data and data related to maintenance activities received from CPM 268, perform comparisons between samples of data received from CPM 268 and the latest data stored on off-board server 270, and send updates for data to CPM 268 when the data stored at off-board server 270 is more up-to-date than samples of data received from CPM 268. Off-board server 270 may embody, for example, one or more of a laptop computer, a work station, a personal digital assistant, a mainframe, a cellular phone, a tablet, a computerized accessory, and/or other computing systems known in the art.

Figure 3:
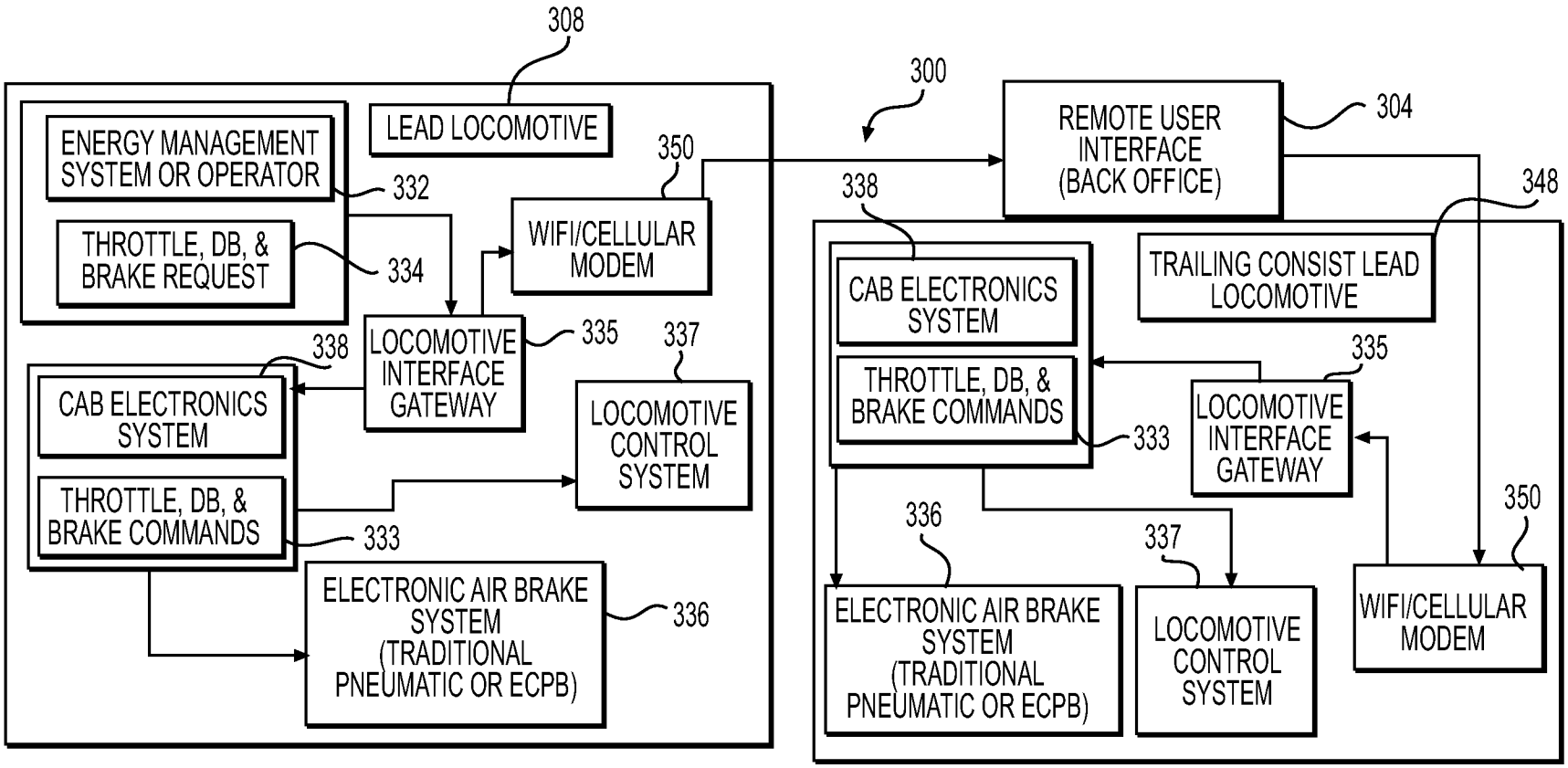
FIG. 3 is a block diagram of an exemplary implementation of a portion of the control system illustrated in FIG. 1.

As shown in FIG. 3, the on-board controls may include an energy management system 332 configured to determine, e.g., one or more of throttle requests, dynamic braking requests, and pneumatic braking requests 334 for one or more of the powered and non-powered units of the train. The energy management system 332 may be configured to make these various requests based on a variety of measured operational parameters, track conditions, freight loads, trip plans, and predetermined maps or other stored data with one or more goals of improving availability, reliability, safety, timeliness, overall fuel economy and emissions output for individual powered units, consists, or the entire train. The cab of the lead powered unit in each of the consists may also house a plurality of input devices and control system interfaces. The input devices may be used by an operator to manually control the locomotive, or may be controlled electronically via messages received from off-board the train. Input devices may include, among other things, an engine run/isolation switch, a generator field switch, an automatic brake handle, an independent brake handle, a lockout device, and any number of circuit breakers. Manual input devices may include switches, levers, pedals, wheels, knobs, push-pull devices, touch screen displays, etc.

Operation of the engines, generators, inverters, converters, and other auxiliary devices may be at least partially controlled by switches or other input devices that may be manually movable between a run or activated state and an isolation or deactivated state by an operator of the train 102. The input devices may be additionally or alternatively activated and deactivated by solenoid actuators or other electrical, electromechanical, or electro-hydraulic devices. As one example, a toggling device associated with an engine (not shown) may be manually and/or autonomously moved to a run state, in which the engine may be allowed to start in response to a command generated from on-board the train, or in response to a command received from the off-board remote controller interface 104. The toggling device may also be moved to an isolation state, in which the engine may be shutdown (i.e., turned off) and not allowed to restart. In one embodiment, moving the toggling device to the run state causes startup of the engine and, likewise, moving the toggling device to the isolation state causes the engine to shut down. In another embodiment, moving the toggling device to the run state simply allows subsequent startup of the engine using other input devices, and the toggling device is only moved to the isolation state after engine shutdown to inhibit restart of the engine. In either scenario, the engine may not be restarted from on-board the train while the toggling device is in the isolation state. The operator of the locomotive may manually move the toggling device to the run state at the start of a work shift or trip, and move the toggling device to the isolation position at the end of the work shift or trip. The off-board remote controller interface 104 may also require compliance with security protocols to ensure that only designated personnel may remotely activate or deactivate components on-board the train from the off-board remote controller interface 104 after certain prerequisite conditions have been met. The off-board remote controller interface may include various security algorithms or other means of comparing an operator authorization input with a predefined security authorization parameter or level. The security algorithms may also establish restrictions or limitations on controls that may be performed based on the location of a locomotive, authorization of an operator, and other parameters.

Circuit breakers may be associated with particular components or subsystems of a locomotive on the train, and configured to trip when operating parameters associated with the components or subsystems deviate from expected or predetermined ranges. For example, circuit breakers may be associated with power directed to individual traction motors, HVAC components, and lighting or other electrical components, circuits, or subsystems. When a power draw greater than an expected draw occurs, the associated circuit breaker may trip, or switch from a first state to a second state, to interrupt the corresponding circuit. In some implementations of this disclosure, a circuit breaker may be associated with an on-board control system or communication unit that controls wireless communication with the off-board remote controller interface 104. After a particular circuit breaker trips, the associated component or subsystem may be disconnected from the main electrical circuit of the locomotive 102 and remain nonfunctional until the corresponding breaker is reset. The circuit breakers may be manually tripped or reset. Alternatively or in addition, the circuit breakers may include actuators or other control devices that can be selectively energized to autonomously or remotely switch the state of the associated circuit breakers in response to a corresponding command received from the off-board remote controller interface 104. In some embodiments, a maintenance signal may be transmitted to the off-board remote controller interface 104 upon switching of a circuit breaker from a first state to a second state, thereby indicating that action such as a reset of the circuit breaker may be needed.

The control system 258 may also include a microprocessor-based locomotive control system 337 having at least one programmable logic controller (PLC), a cab electronics system 338, and an electronic air (pneumatic) brake system 336, all mounted within a cab of the locomotive. The cab electronics system 338 may comprise at least one integrated display computer configured to receive and display data from the outputs of one or more of machine gauges, indicators, sensors, and controls. The cab electronics system 338 may be configured to process and integrate the received data, receive command signals from the off-board remote user interface 304, and communicate commands such as throttle, dynamic braking, and pneumatic braking commands 333 to the microprocessor-based locomotive control system 337.

The microprocessor-based locomotive control system 337 may be communicatively coupled with the traction motors, engines, generators, braking subsystems, input devices, actuators, circuit breakers, and other devices and hardware used to control operation of various components and subsystems on the locomotive. In various alternative implementations of this disclosure, some operating commands, such as throttle and dynamic braking commands, may be communicated from the cab electronics system 338 to the locomotive control system 337, and other operating commands, such as braking commands, may be communicated from the cab electronics system 338 to a separate electronic air brake system 336. One of ordinary skill in the art will recognize that the various functions performed by the locomotive control system 337 and electronic air brake system 336 may be performed by one or more processing modules or controllers through the use of hardware, software, firmware, or various combinations thereof. Examples of the types of controls that may be performed by the locomotive control system 337 may include radar-based wheel slip control for improved adhesion, automatic engine start stop (AESS) for improved fuel economy, control of the lengths of time during which traction motors are operated at temperatures above a predetermined threshold, control of generators/alternators, control of inverters/converters, the amount of exhaust gas recirculation (EGR) and other exhaust after-treatment processes performed based on detected levels of certain pollutants, and other controls performed to improve safety, increase overall fuel economy, reduce overall emission levels, and increase longevity, reliability, and availability of the locomotives. The at least one PLC of the locomotive control system 337 may also be configurable to selectively set predetermined ranges or thresholds for monitoring operating parameters of various subsystems. When a component detects that an operating parameter has deviated from the predetermined range, or has crossed a predetermined threshold, a maintenance signal may be communicated off-board to the remote user interface 304. The at least one PLC of the locomotive control system 337 may also be configurable to receive one or more command signals indicative of at least one of a throttle command, a dynamic braking readiness command, and an air brake command 333, and output one or more corresponding command control signals configured to at least one of change a throttle position, activate or deactivate dynamic braking, and apply or release a pneumatic brake, respectively.

The cab electronics system 338 may provide integrated computer processing and display capabilities on-board the train, and may be communicatively coupled with a plurality of cab gauges, indicators, and sensors, as well as being configured to receive commands from the remote user interface 304. The cab electronics system 338 may be configured to process outputs from one or more of the gauges, indicators, and sensors, and supply commands to the locomotive control system 337. In various implementations, the remote user interface 304 may comprise a laptop, hand-held device, or other computing device or server with software, encryption capabilities, and Internet access for communicating with the on-board controller of the lead locomotive 308 of a lead consist and the lead locomotive 348 of a trailing consist. Control commands generated by the cab electronics system 338 on the lead locomotive 308 of the lead consist may be communicated to the locomotive control system 337 of the lead locomotive of the lead consist, and may be communicated in parallel via a WiFi/cellular modem 350 off-board to the remote user interface 304. The lead communication unit 120 on-board the lead locomotive of the lead consist may include the WiFi/cellular modem 350 and any other communication equipment required to modulate and transmit the command signals off-board the locomotive and receive command signals on-board the locomotive. As shown in FIG. 3, the remote user interface 304 may relay commands received from the lead locomotive 308 via another WiFi/cellular modem 350 to another cab electronics system 338 on-board the lead locomotive 348 of the trailing consist.

The control systems and interfaces on-board and off-board the train may embody single or multiple microprocessors, field programmable gate arrays (FPGAs), digital signal processors (DSPs), programmable logic controllers (PLCs), etc., that include means for controlling operations of the train 102 in response to operator requests, built-in constraints, sensed operational parameters, and/or communicated instructions from the remote user interface 304. Numerous commercially available microprocessors can be configured to perform the functions of these components. Various known circuits may be associated with these components, including power supply circuitry, signal-conditioning circuitry, actuator driver circuitry (i.e., circuitry powering solenoids, motors, or piezo actuators), and communication circuitry.

The locomotives may be outfitted with any number and type of sensors known in the art for generating signals indicative of associated operating parameters. In one example, a locomotive may include a temperature sensor configured to generate a signal indicative of a coolant temperature of an engine on-board the locomotive. Additionally or alternatively, sensors may include brake temperature sensors, exhaust sensors, fuel level or fuel flow sensors, pressure sensors, knock sensors, reductant level or temperature sensors, speed sensors, motion detection sensors, location sensors, or any other sensor known in the art. The signals generated by the sensors may be directed to the cab electronics system 338 for further processing and generation of appropriate commands.

Any number and type of warning devices may also be located on-board each locomotive, including an audible warning device and/or a visual warning device. Warning devices may be used to alert an operator on-board a locomotive of an impending operation, for example startup of the engine(s). Warning devices may be triggered manually from on-board the locomotive (e.g., in response to movement of a component to the run state) and/or remotely from off-board the locomotive (e.g., in response to commands from the remote user interface 304.) Maintenance activities such as replacement of components, replacement or addition of fluids, and adjustments to components may also trigger signals that are communicated to the on-board CPM 268 or off-board to the remote user interface 304. When triggered from off-board the locomotive, a corresponding command signal used to initiate operation of the warning device may be communicated to the on-board controller and the cab electronics system 338.

The off-board remote user interface 304 may include any means for monitoring, recording, storing, indexing, processing, and/or communicating various operational aspects of the locomotive. These means may include components such as, for example, a memory, one or more data storage devices, a central processing unit, or any other components that may be used to run an application. Furthermore, although aspects of the present disclosure may be described generally as being stored in memory, one skilled in the art will appreciate that these aspects can be stored on or read from different types of computer program products or non-transitory computer-readable media such as computer chips and secondary storage devices, including hard disks, floppy disks, optical media, CD-ROM, or other forms of RAM or ROM.

The off-board remote user interface 304 may be configured to execute instructions stored on computer readable media to perform methods of remote control of the locomotives or other powered units. That is, as will be described in more detail in the following section, on-board control (manual and/or autonomous control) of some operations of the locomotive (e.g., operations of traction motors, engine(s), circuit breakers, etc.) may be selectively overridden by the off-board remote user interface 304.

Remote control of the various powered and non-powered units on the train 102 through communication between the on-board cab electronics system 338 and the off-board remote user interface 304 may be facilitated via the various communication units 120, 126, 160, 166 spaced along the train 102. The communication units may include hardware and/or software that enables sending and receiving of data messages between the powered units of the train and the off-board remote controller interfaces. The data messages may be sent and received via a direct data link and/or a wireless communication link, as desired. The direct data link may include an Ethernet connection, a connected area network (CAN), or another data link known in the art. The wireless communications may include satellite, cellular, infrared, and any other type of wireless communications that enable the communication units to exchange information between the off-board remote controller interfaces and the various components and subsystems of the train 102.

As shown in the exemplary embodiment of FIG. 3, the cab electronics system 338 may be configured to receive the requests 334 after they have been processed by the locomotive interface gateway (LIG) 335, which may also enable modulation and communication of the requests through a WiFi/cellular modem 350 to off-board remote controller interface 304 (back office). The cab electronics system 338 may be configured to communicate commands (e.g., throttle, dynamic braking, and braking commands 333) to the locomotive control system 337 and an electronic air (pneumatic) brake system 336 on-board the lead locomotive 308 in order to autonomously control the movements and/or operations of the lead locomotive.

In parallel with communicating commands to the locomotive control system 337 of the lead locomotive 308, the cab electronics system 338 on-board the lead locomotive 308 of the lead consist may also communicate commands to the off-board remote user interface 304. The commands may be communicated either directly or through the locomotive interface gateway 335, via the WiFi/cellular modem 350, off-board the lead locomotive 308 of the lead consist to the remote user interface 304. The remote user interface 304 may then communicate the commands received from the lead locomotive 308 to the trailing consist lead locomotive 348. The commands may be received at the trailing consist lead locomotive 348 via another WiFi/cellular modem 350, and communicated either directly or through another locomotive interface gateway 335 to a cab electronics system 338. The cab electronics system 338 on-board the trailing consist lead locomotive 348 may be configured to communicate the commands received from the lead locomotive 308 of the lead consist to a locomotive control system 337 and an electronic air brake system 336 on-board the trailing consist lead locomotive 348. The commands from the lead locomotive 308 of the lead consist may also be communicated via the network connection 118 from the trailing consist lead locomotive 348 to one or more trailing powered units 150 of the trailing consist 140. The result of configuring all of the lead powered units of the lead and trailing consists to communicate via the off-board remote user interface 304 is that the lead powered unit of each trailing consist may respond quickly and in close coordination with commands responded to by the lead powered unit of the lead consist. Additionally, each of the powered units in various consists along a long train may quickly and reliably receive commands such as throttle, dynamic braking, and pneumatic braking commands 334 initiated by a lead locomotive in a lead consist regardless of location and conditions.

The integrated cab electronics systems 338 on the powered units of the lead consist 114 and on the powered units of the trailing consist 140 may also be configured to receive and generate commands for configuring or reconfiguring various switches and handles on-board each of the powered units of the train as required before the train begins on a journey, or after a failure occurs that requires reconfiguring of all or some of the powered units. Examples of switches and handles that may require configuring or reconfiguring before a journey or after a failure may include an engine run switch, a generator field switch, an automatic brake handle, and an independent brake handle. Remotely controlled actuators on-board the powered units in association with each of the switches and handles may enable remote, autonomous configuring and reconfiguring of each of the devices. For example, before the train begins a journey, or after a critical failure has occurred on one of the lead or trailing powered units, commands may be sent from the off-board remote user interface 304 to any powered unit in order to automatically reconfigure all of the switches and handles as required on-board each powered unit without requiring an operator to be on-board the train. Following the reconfiguring of all of the various switches and handles on-board each locomotive, the remote user interface may also send messages to the cab electronics systems on-board each locomotive appropriate for generating other operational commands such as changing throttle settings, activating or deactivating dynamic braking, and applying or releasing pneumatic brakes. This capability saves the time and expense of having to delay the train while sending an operator to each of the powered units on the train to physically switch and reconfigure all of the devices required.

An exemplary method of managing train assets in accordance with various aspects of this disclosure is described in more detail in the following section.

INDUSTRIAL APPLICABILITY

The train asset management system and functions of the present disclosure may be applicable to any group of locomotives or other powered machines where the ability to predict the effects of changing various operational characteristics and maintenance activities on availability and reliability of the train assets may be desirable. The functions performed by disclosed implementations of the train asset management system may improve the availability and reliability of various train assets by predicting the effects of hypothetical changes to operational parameters, designated operational configurations of the assets, and maintenance activities, and implementing the changes to achieve desired results. These functions may be controlled manually from on-board each locomotive and/or remotely from an off-board controller in order to provide a way to enable automatic train operation (ATO) when human operators are not present or available at the locomotives.

Figure 4:
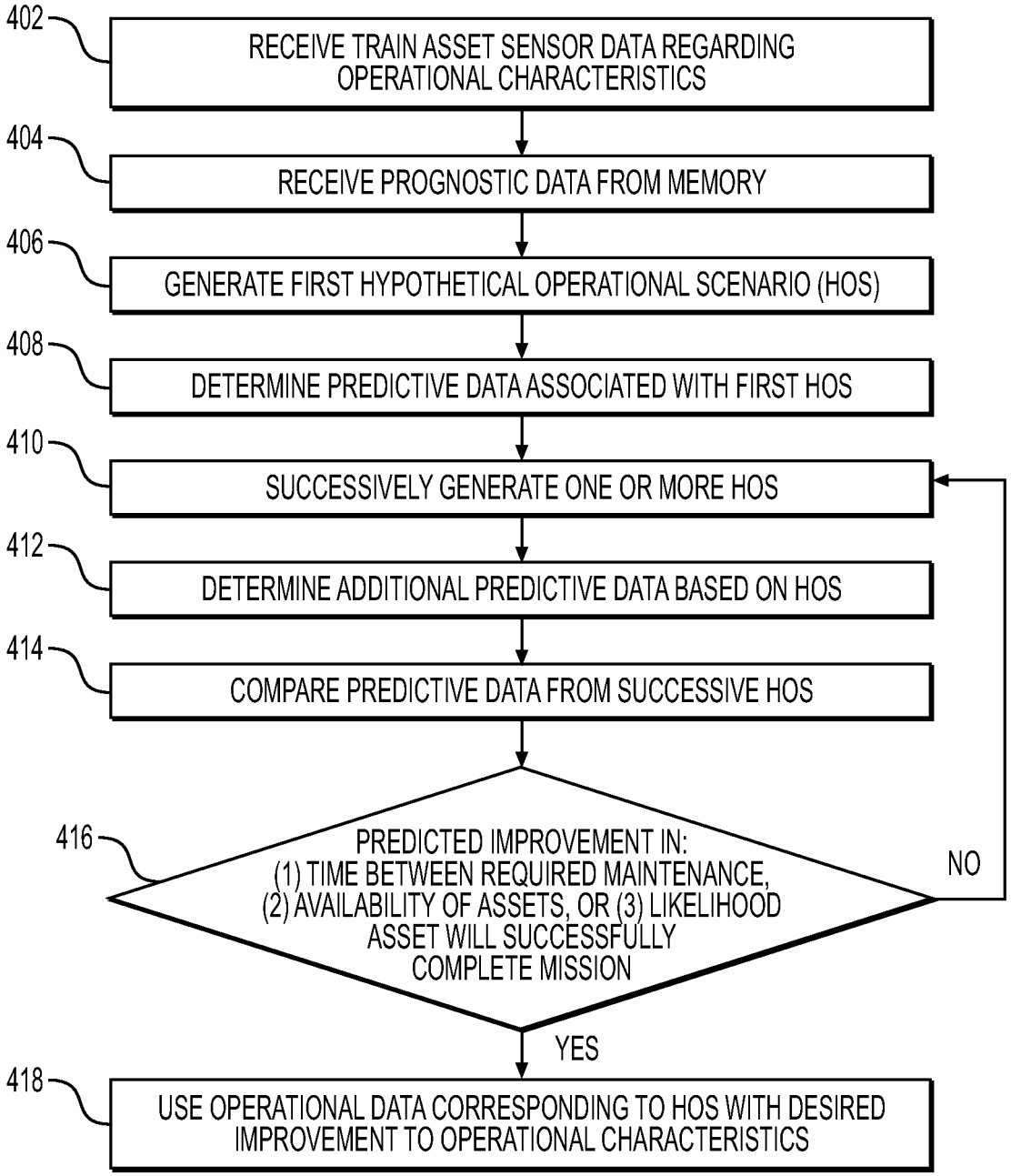
FIG. 4 is a flowchart illustrating one implementation of a procedure that may be performed by the control system of FIG. 1.

The train asset management functions of the control system of a train may be performed in order to at least one of increase the time between required maintenance of the train assets, improve the future availability of the train assets, or increase the likelihood that the train assets will successfully complete future missions. As shown in FIG. 4, Step 402 of an exemplary method for implementing train asset management may include receiving train asset sensor data regarding operational characteristics of the asset. The sensor data may include real-time signals indicative of operational parameters of the propulsion systems, such as fluid levels, fluid flow rates, fluid temperatures, pressures, voltage, current, power, torque, and the like. The sensor data may also include signals indicative of maintenance activities or failures of systems, subsystems, or components of the train asset.

At Step 404, the method may include receiving from a memory prognostic data providing information on a likelihood the train asset will complete a mission. The prognostic data may be objectively measurable, and may include data such as the age of a train asset, the occurrence of maintenance activities performed on the asset and the current maintenance status of the asset, historical mean time between failures of systems, subsystems, equipment, or components of the asset, and changes to expected operational parameters for the asset. The prognostic data may also include the length of time or number of miles the asset has been in service, the length of time during which one or more propulsion subsystems of the asset have been operated above a threshold level of power output, the types of loads the train asset has been subjected to, the terrain and environmental conditions under which the train asset has been operated, the timing and nature of any maintenance activities performed on the asset, the particular type, make, or model of the asset, and the type of propulsion subsystem and fuel used by the asset. In some alternative implementations, the method may also include analyzing the real-time signals received from the train asset sensors and the prognostic data to identify any patterns or trends in operational characteristics of the train asset. Identification of patterns or trends in the operational characteristics may allow the train asset management system in accordance with various implementations of this disclosure to predict the potential benefits associated with early replacement or maintenance of components before failure occurs.

At Step 406, the train asset management functions performed by the control system may include generating a first hypothetical operational scenario (HOS) involving one or more train assets. The HOS may be generated by one or more processors on-board the locomotive as part of the CPM, for example, or off-board the locomotive at a back office. The one or more processors may simulate the HOS based on one or more of historical data, empirical data, theoretical data derived from physics-based equations and algorithms, and statistically-derived data based on past performance of the asset or other assets that are of the same or similar type or model. At Step 408, the one or more processors may determine predictive data associated with the first HOS providing information on a likely benefit to a train asset from a change in at least one of an operational parameter, designated operational configuration for the train assets, or maintenance-related activity.

At Step 410, the one or more processors of the train asset management system may successively generate one or more additional HOS. The processors may simulate successive HOS by changing operational parameters, maintenance activities, dimensional thresholds at which worn parts are repaired or replaced, and other characteristics that may have an effect on availability and/or reliability of a train asset. At Step 412, the processors may determine additional predictive data based on the one or more additional HOS, and at Step 414, compare the predictive data from successive HOS.

Comparison of the predictive data from successive HOS may allow for a determination at Step 416 of whether the latest HOS has resulted in a predicted or expected improvement in at least one of time between required future maintenance procedures for the train asset, future availability of the train asset, or likelihood that the train asset will successfully complete future missions. If a predicted improvement results (Step 416: YES), the asset management system may use operational data corresponding to the HOS with desired improvements to operational characteristics to initiate control commands based on the predictive data and any identified patterns or trends in operational characteristics of the train assets. If there is no improvement (Step 416: NO), the asset management system may loop back to continue successively generating additional HOS (Step: 410) in order to determine what changes to operational characteristics, designated operational configurations of the train assets, or maintenance-related activities may result in the desired operational improvements.

During normal operation, a human operator may be located on-board the lead locomotive 308 and within the cab of the locomotive. The human operator may be able to control when an engine or other subsystem of the train is started or shut down, which traction motors are used to propel the locomotive, what switches, handles, and other input devices are reconfigured, and when and what circuit breakers are reset or tripped. The human operator may also be required to monitor multiple gauges, indicators, sensors, and alerts while making determinations on what controls should be initiated. However, there may be times when the operator is not available to perform these functions, when the operator is not on-board the locomotive 308, and/or when the operator is not sufficiently trained or alert to perform these functions. In addition, the control system 300 in accordance with this disclosure facilitates remote access to and availability of the locomotives in a train for authorized third parties, including providing redundancy and reliability of monitoring and control of the locomotives and subsystems on-board the locomotives. As discussed in detail above, the control system may also include a train asset management system that simulates HOS and determines predictive data from the HOS that can then be used to provide control command signals to the train assets. The predictive data may result in changes to operational characteristics, designated operational configurations of the train assets, or maintenance-related activities that achieve desired operational improvements and increased availability and reliability of the train assets.

A method of managing and controlling train assets in lead and trailing consists of a train in accordance with various aspects of this disclosure may include transmitting an operating control command from a lead locomotive in a lead consist of a train off-board to a remote controller interface. The remote controller interface may then relay that operating control command to one or more lead locomotives of one or more trailing consists of the train. In this way, the one or more trailing consists of the train may all respond reliably and in parallel with the same control commands that are being implemented on-board the lead locomotive of the lead consist. As discussed above, on-board controls of the lead locomotive of the lead consist in the train may include the energy management system or human operator 332 providing one or more of throttle, dynamic braking, or braking requests 334 to the cab electronics system 338. The cab electronics system 338 may process and integrate these requests along with other outputs from various gauges and sensors, and commands that may have been received from the off-board remote user interface 304. The cab electronics system 338 may then communicate commands to the on-board locomotive control system 337. In parallel with these on-board communications, the cab electronics system 338 may communicate the same commands via a WiFi/cellular modem 350, or via locomotive interface gateway 335 and WiFi/cellular modem 350 to the off-board remote user interface 304. In various alternative implementations, the off-board remote user interface 304 may further process the commands received from the lead locomotive 308 of the lead consist in order to modify the commands before transmitting the commands to lead locomotives of trailing consists. Modification of the commands may be based on additional information the remote controller interface has acquired from the lead locomotives of the trailing consists, trip plans, and information from maps or other stored data. The commands may be received from the remote user interface 304 in parallel at each of the lead locomotives 348 of multiple trailing consists.

In addition to throttle, dynamic braking, and braking commands, the remote user interface 304 may also communicate other commands to the cab electronics systems of the on-board controllers on one or more lead locomotives in multiple trailing consists. These commands may include switching a component such as a circuit breaker on-board a locomotive from a first state, in which the circuit breaker has not tripped, to a second state, in which the circuit breaker has tripped. The circuit breaker may be tripped in response to detection that an operating parameter of at least one component or subsystem of the locomotive has deviated from a predetermined range. When such a deviation occurs, a maintenance signal may be transmitted from the locomotive to the off-board remote user interface 304. The maintenance signal may be indicative of a subsystem having deviated from the predetermined range as indicated by a circuit breaker having switched from a first state to a second state. The method may further include selectively receiving a command signal from the remote user interface 304 at a control device on-board the locomotive, with the command signal causing the control device to autonomously switch the component from the second state back to the first state. In the case of a tripped circuit breaker, the command may result in resetting the circuit breaker.

The method of remotely controlling the locomotives in various consists of a train may also include configuring one or more programmable logic controllers (PLC) of microprocessor-based locomotive control systems 337 on-board one or more lead locomotives to selectively set predetermined ranges for operating parameters associated with various components or subsystems. In one exemplary implementation, a locomotive control system 337 may determine that a circuit of a particular subsystem of the associated locomotive is operating properly when the current flowing through the circuit falls within a particular range. A circuit breaker may be associated with the circuit and configured to trip when the current flowing through the circuit deviates from the determined range. In another exemplary implementation, the locomotive control system may determine that a particular flow rate of exhaust gas recirculation (EGR), or flow rate of a reductant used in exhaust gas aftertreatment, is required in order to meet particular fuel economy and/or emission levels. A valve and/or pump regulating the flow rate of exhaust gas recirculation and/or reductant may be controlled by the locomotive control system when a level of a particular pollutant deviates from a predetermined range. The predetermined ranges for various operating parameters may vary from one locomotive to another based on specific characteristics associated with each locomotive, including age, type, model, location, weather conditions, type of propulsion system, fuel efficiency, type of fuel, and the like.

The method of managing and controlling one or more train assets in accordance with various implementations of this disclosure may still further include cab electronics system 338 on-board a locomotive receiving and processing data outputs from one or more of gauges, indicators, sensors, and controls on-board the locomotive. The cab electronics system 338 may also receive and process, e.g., throttle, dynamic braking, and pneumatic braking requests from the energy management system and/or human operator 332 on-board the locomotive, and command signals from the off-board remote user interface 304. The cab electronics system 338 may then communicate appropriate commands to the locomotive control system 337 and/or electronic air brake system 336 based on the requests, data outputs and command signals. The locomotive control system 337 may perform various control operations such as resetting circuit breakers, adjusting throttle settings, activating dynamic braking, and activating pneumatic braking in accordance with the commands received from the cab electronics system 338.

It will be apparent to those skilled in the art that various modifications and variations can be made to the train asset management system and methods of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A train asset management system, comprising:

a plurality of sensors associated with one or more train assets, each of the plurality of sensors being configured to generate a real-time signal indicative of at least one of a measured operational characteristic, a maintenance activity, or a failure associated with a train asset; and a controller configured to:

receive the real-time signals from the sensors;

receive from memory prognostic data providing information on a likelihood the train asset will complete a mission;

run successive simulations of operation of the train asset under different hypothetical operating conditions based at least in part on the prognostic data;

determine predictive data from the successive simulations providing information on effects of changes in the different hypothetical operating conditions;

wherein the different hypothetical operating conditions may represent hypothetical changes in:

an operational parameter;

a designated operational configuration for the train asset; or a maintenance-related activity;

compare the predictive data from the successive simulations;

determine a predicted improvement, based on the predictive data, in at least one of:

time between required maintenance procedures for the train asset;

availability of the train asset; or likelihood that the train asset will successfully complete a mission; and initiate control commands for the train asset based on one of the changes in the different hypothetical operating conditions corresponding to the predicted improvement.

2. The train asset management system of claim 1, wherein the controller is further configured to analyze the real-time signals and the prognostic data to identify any patterns or trends in operational characteristics of the one or more train assets.

3. The train asset management system of claim 1, wherein the prognostic data is objectively measurable data comprising one or more of the age of a particular train asset, the length of time or number of miles the asset has been in service, the length of time during which one or more propulsion subsystems of the asset have been operated above a threshold level of power output, the types of loads the train asset has been subjected to, the terrain and environmental conditions under which the train asset has been operated, the timing and nature of any maintenance activities performed on the asset, the particular type, make, or model of the asset, and the type of propulsion subsystem and fuel used by the asset.

4. The train asset management system of claim 1, wherein the controller comprises:

a first on-board controller located on-board a lead locomotive of a lead consist of the train and communicatively coupled with a first lead communication unit;

a second on-board controller located on-board a lead locomotive of a trailing consist of the train and communicatively coupled with a second lead communication unit;

each of the first and second on-board controllers comprising:

a cab electronics system comprising at least one integrated display computer configured to:

receive and display data from outputs of one or more of machine gauges, indicators, sensors, and controls;

process and integrate the received data;

receive one or more control command signals from an off-board remote controller interface; and communicate commands based on the data and the received one or more control command signals; and a locomotive control system, wherein the locomotive control system is configured to receive commands communicated from the cab electronics system; and the first and second on-board controllers being configured for wireless communication with the off-board remote controller interface.

5. The train asset management system of claim 4, wherein each of the first and second lead communication units comprises a wireless modem configured to communicate data messages in the form of packetized data with the off-board remote controller interface.

6. The train asset management system of claim 4, wherein the first and second lead communication units are configured to communicate with the off-board remote controller interface over the Internet.

7. The train asset management system of claim 4, wherein locomotive control commands from the lead locomotive of the lead consist comprise at least one of a throttle command, a dynamic braking readiness command, and a brake command.

8. The train asset management system of claim 4, wherein the commands communicated from the cab electronics system are configured to at least one of change a designated operational configuration of one or more train assets, change a throttle position, activate or deactivate dynamic braking, and apply or release a brake.

9. A computer-implemented method for managing train assets in order to at least one of increase the time between required maintenance of the train assets, improve the future availability of the train assets, or increase the likelihood that the train assets will successfully complete future missions; the method implemented by a train asset management system and comprising:

receiving, at a controller of the train asset management system, from a sensor on a train asset a real-time signal indicative of at least one of a measured operational characteristic or a maintenance activity associated with the train asset;

receiving, at the controller, from a memory prognostic data providing information on a likelihood the train asset will complete a mission;

using the controller to:

run successive simulations of operation of the train asset under different hypothetical operating conditions based at least in part on the prognostic data;

determine predictive data from the successive simulation providing information on effects of changes in the different hypothetical operating conditions, wherein the different hypothetical operating conditions may represent hypothetical changes in an operational parameter, designated operational configuration for the train assets, or maintenance-related activity;

compare the predictive data from the successive simulations;

determine a predicted improvement, based on the predictive data, at least one of time between required future maintenance procedures for the train asset, future availability of the train asset, or likelihood that the train asset will successfully complete future missions; and initiate control commands for the train asset based on one of the changes in the different hypothetical operating conditions corresponding to the predicted improvement.

10. The method of claim 9, further including:

analyzing, using the controller, real-time signals from a plurality of sensors and the prognostic data to identify any patterns or trends in operational characteristics of the one or more train assets.

11. The method of claim 9, wherein the prognostic data is objectively measurable data comprising one or more of the age of a particular train asset, the length of time or number of miles the asset has been in service, the length of time during which one or more propulsion subsystems of the asset have been operated above a threshold level of power output, the types of loads the train asset has been subjected to, the terrain and environmental conditions under which the train asset has been operated, the timing and nature of any maintenance activities performed on the asset, the particular type, make, or model of the asset, and the type of propulsion subsystem and fuel used by the asset.

12. The method of claim 9, further including:

communicatively coupling a first on-board controller located on-board a lead locomotive of a lead consist of the train with a first lead communication unit;

communicatively coupling a second on-board controller located on-board a lead locomotive of a trailing consist of the train with a second lead communication unit;

receiving and displaying data from outputs of one or more of machine gauges, indicators, sensors, and controls at a cab electronics system of at least one of the first and second on-board controllers;

processing and integrating the received data at the cab electronics system;

receiving one or more control command signals communicated wirelessly to the cab electronics system from an off-board remote controller interface;

communicating commands from the cab electronic system based on the integrated received data and the received one or more control command signals; and receiving commands communicated from the cab electronics system at a locomotive control system on-board at least one of the lead locomotives.

13. The method of claim 12, wherein each of the first and second lead communication units communicates data messages with the off-board remote controller interface in the form of packetized data transmitted and received through a wireless modem.

14. The method of claim 12, wherein locomotive control commands from the lead locomotive of the lead consist comprise at least one of a throttle command, a dynamic braking readiness command, and a brake command.

15. The method of claim 12, wherein the commands communicated from the cab electronics system are configured to at least one of change a designated operational configuration of one or more train assets, change a throttle position, activate or deactivate dynamic braking, and apply or release a brake.

16. A non-transitory computer-readable media comprising computer-executable instructions that, when executed on one or more processors, perform acts that at least one of increase the time between required maintenance of one or more train assets, improve the future availability of the one or more train assets, or increase the likelihood that the one or more train assets will successfully complete future missions, the acts including:

receiving from a sensor on a train asset a real-time signal indicative of at least one of a measured operational characteristic or a maintenance activity associated with the train asset;

receiving from a memory prognostic data providing information on a likelihood the train asset will complete a mission;

running successive simulations of operation of the train asset under different hypothetical operating conditions based at least in part on the prognostic data;

determining predictive data from the successive simulations providing information on effects of changes in the different hypothetical operating conditions, wherein the different hypothetical operating conditions may represent hypothetical changes in an operational parameter, designated operational configuration for the train assets, or maintenance-related activity;

comparing the predictive data from the successive simulations;

determining predicted improvement, based on the predictive data, in at least one of time between required maintenance procedures for the train asset, availability of the train asset, or likelihood that the train asset will successfully complete a mission; and initiating control commands for the train asset based on one of the changes in the different hypothetical operating conditions corresponding to the predicted improvement.

17. The non-transitory computer-readable media of claim 16, wherein the computer-executable instructions, when executed on one or more processors, perform acts that further include analyzing the real-time signals and the prognostic data to identify any patterns or trends in operational characteristics of the one or more train assets.

18. The non-transitory computer-readable media of claim 16, wherein the prognostic data is objectively measurable data comprising one or more of the age of a particular train asset, the length of time or number of miles the asset has been in service, the length of time during which one or more propulsion subsystems of the asset have been operated above a threshold level of power output, the types of loads the train asset has been subjected to, the terrain and environmental conditions under which the train asset has been operated, the timing and nature of any maintenance activities performed on the asset, the particular type, make, or model of the asset, and the type of propulsion subsystem and fuel used by the asset.

* * * * *